US005953571A

United States Patent [19]

Thompson

[11] Patent Number: 5,953,571

[45] Date of Patent: Sep. 14, 1999

[54] APPARATUS AND METHOD FOR LOADING A DONOR MEMBER

[75] Inventor: Michael D. Thompson, Rochester, N.Y.

[73] Assignee: Xerox Corporation, Stamford, Conn.

[21] Appl. No.: 09/177,075

[22] Filed: Oct. 22, 1998

[51] Int. Cl.[6] ..... G03G 15/08

[52] U.S. Cl. ..... 399/290; 399/266; 399/281

[58] Field of Search ..... 399/256, 258, 399/265, 266, 272, 279, 281, 290, 291; 355/247, 248, 249, 259; 430/120

[56] References Cited

U.S. PATENT DOCUMENTS

| | | | |
|---|---|---|---|
| 3,133,833 | 5/1964 | Giaimo, Jr. | 399/290 |
| 3,882,822 | 5/1975 | Sullivan, Jr. | 399/290 |
| 4,777,106 | 10/1988 | Fotland et al. | 430/120 |
| 5,532,100 | 7/1996 | Christy et al. | 430/120 |

*Primary Examiner*—Arthur T. Grimley
*Assistant Examiner*—Hoang Ngo

[57] ABSTRACT

An apparatus for simultaneously fluidizing, charging and loading toner onto a donor member in one step using a corona device which is enclosed and separate from the toner supply. An ion-air stream emanating from this charging device also directs the charged toner onto the donor. The system includes a housing for containing toner particles; a donor member, mounted in said housing, for transporting charged toner particles on the surface said donor member to a development zone adjacent to said image bearing member; a loading system for loading said donor member with charged toner particles, said loading system includes blower for generating an air stream for fluidizing toner particles and charging device for charging said air stream.

6 Claims, 5 Drawing Sheets

APPARATUS AND METHOD FOR LOADING A DONOR MEMBER

This invention relates generally to a development apparatus for ionographic or electrophotographic imaging and printing apparatuses and machines, and more particularly is directed to an apparatus and method for loading a donor member.

Generally, the process of electrophotographic printing includes charging a photoconductive member to a substantially uniform potential so as to sensitize the surface thereof. The charged portion of the photoconductive surface is exposed to a light image from either a scanning laser bean or an original document being reproduced. This records an electrostatic latent image on the photoconductive surface. After the electrostatic latent image is recorded on the photoconductive surface, the latent image is developed. Two component and single component developer materials are commonly used for development. A typical two component developer comprises magnetic carrier granules having toner particles adhering triboelectrically thereto. A single component developer material typically comprises toner particles. Toner particles are attracted to the latent image forming a toner powder image on the photoconductive surface, the toner powder image is subsequently transferred to a copy sheet, and finally, the toner powder image is heated to permanently fuse it to the copy sheet in image configuration.

The electrophotographic marking process given above can be modified to produce color images. One color electrophotographic marking process, called image on image processing, superimposes toner powder images of different color toners onto the photoreceptor prior to the transfer of the composite toner powder image onto the substrate. While image on image process is beneficial, it has several problems. For example, when recharging the photoreceptor in preparation for creating another color toner powder image it is important to level the voltages between the previously toned and the untoned areas of the photoreceptor.

In the application of the toner to the latent electrostatic images contained on the charge-retentive surface, it is necessary to transport the toner from a developer housing to the surface. A basic limitation of conventional xerographic development systems, including both magnetic brush and single component, is the inability to deliver toner(i.e. charged pigment) to the latent images without creating large adhesive forces between the toner and the conveyor which transports the toner to latent images. As will be appreciated, large fluctuation (i.e. noise) in the adhesive forces that cause the pigment to tenaciously adhere to the carrier severely limit the sensitivity of the developer system thereby necessitating higher contrast voltages forming the images. Accordingly, it is desirable to reduce such noise particularly in connection with latent images formed by contrasting voltages.

Fluidized beds have been used to provide a means for storing, mixing and transporting toner in certain single component development systems and loading onto developer rolls. Efficient means for fluidizing toner and charging the particles within the fluidized bed are disclosed in U.S. Pat. No. 4,777,106 and U.S. Pat. No. 5,532,100, which are hereby incorporated by reference. In these disclosures, corona devices are embedded in the fluidized toner for simultaneous toner charging and deposition onto a receiver roll. While the development system as described has been found satisfactory in some development applications, it leaves something to be desired in the way in applications requiring the blending of two or more dry powder toners to achieve custom color development. Also, it has been found in the above systems that there are frequently disturbances to the flow in the fluidized bed associated with charged particles in the high electric fields surrounding corona devices immersed in the reservoir. Also, wire contamination present a reliability issue.

However, noting the issues above the achievement of high reliability and simple, economic manufacturability of the system continue to present problems.

SUMMARY OF THE INVENTION

Briefly, the present invention obviates the problems noted above by utilizing an apparatus for simultaneously fluidizing, charging and loading toner onto a donor member in one step using a corona device which is enclosed and separate from the toner supply. The ion-air stream emanating from this charging device also directs the charged toner onto the donor. The development system of the present invention enables greater simplicity and latitudes in developing high quality, full color images with either an image on image or tandem color process.

There is provided a developer system for developing a latent image of an image bearing member with charge toner particles, the system comprising: a housing for containing toner particles; a donor member, mounted in said housing, for transporting charged toner particles on the surface said donor member to a development zone adjacent to said image bearing member; a loading system for loading said donor member with charged toner particles, said loading system includes means for generating an air stream for fluidizing toner particles and means for charging said air stream.

Inasmuch as the art of electrophotographic printing is well known, the various processing stations employed in the printing machine will be shown hereinafter schematically and their operation described briefly with reference thereto.

Figure 1:
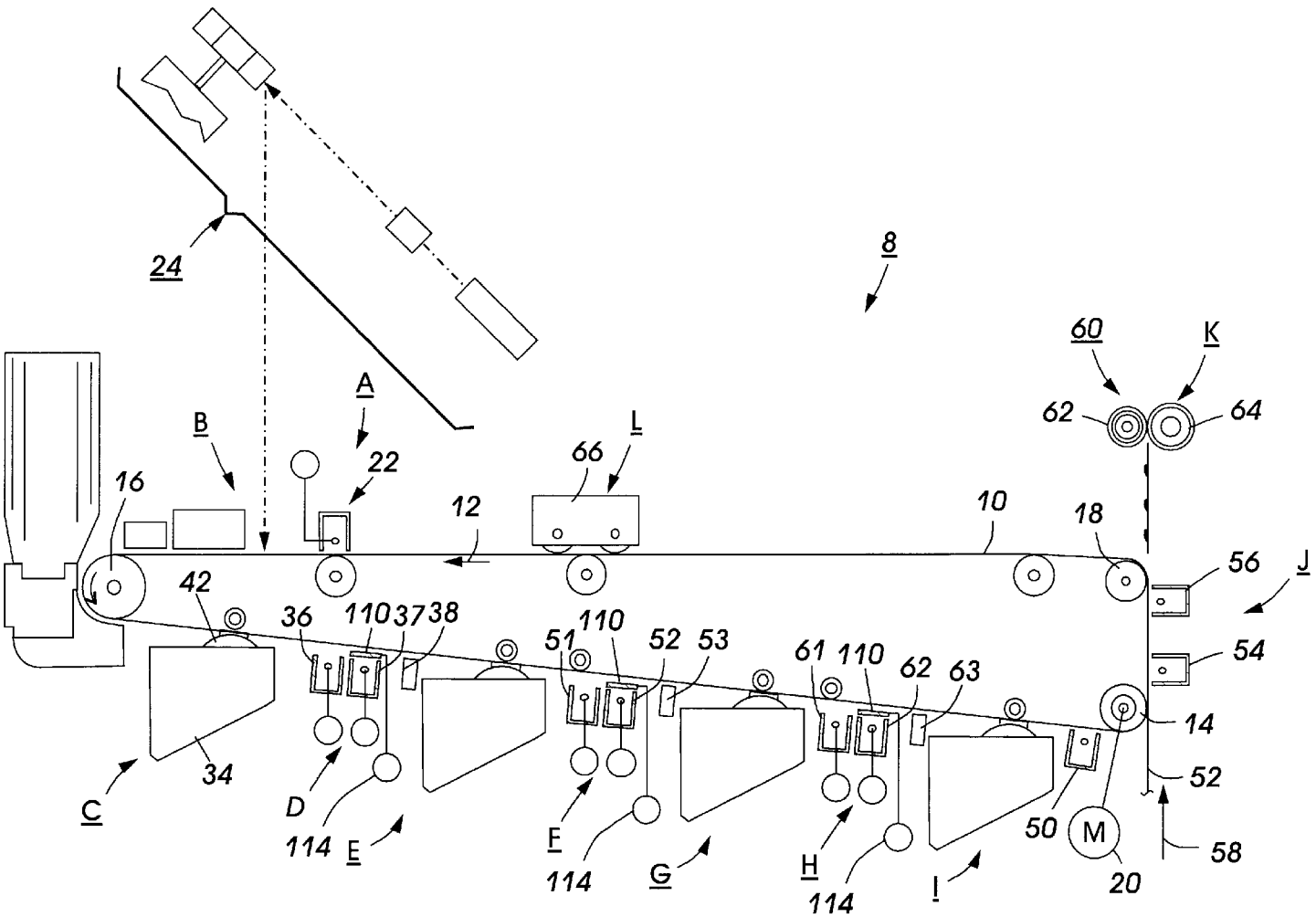
FIG. 1 is schematic elevational view of an illustrative electrophotographic printing or imaging machine or apparatus incorporating a development apparatus having the features of the present invention therein.

Referring initially to FIG. 1, there is shown an illustrative electrophotographic machine having incorporated therein the development apparatus of the present invention. An electrophotographic printing machine creates a color image in a single pass through the machine and incorporates the features of the present invention. The printing machine uses a charge retentive surface in the form of an Active Matrix (AMAT) photoreceptor belt 10 which travels sequentially through various process stations in the direction indicated by the arrow 12. Belt travel is brought about by mounting the belt about a drive roller 14 and two tension rollers 16 and 18 and then rotating the drive roller 14 via a drive motor 20.

As the photoreceptor belt moves, each part of it passes through each of the subsequently described process stations. For convenience, a single section of the photoreceptor belt, referred to as the image area, is identified. The image area is that part of the photoreceptor belt which is to receive the toner powder images which, after being transferred to a substrate, produce the final image. While the photoreceptor belt may have numerous image areas, since each image area is processed in the same way, a description of the typical processing of one image area suffices to fully explain the operation of the printing machine.

Figure 2:
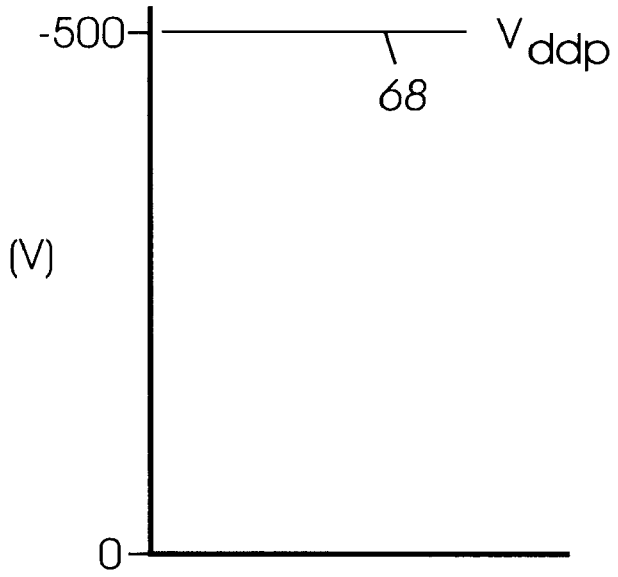
FIG. 2 shows a typical voltage profile of an image area in the electrophotographic printing machines illustrated in FIG. 1 after that image area has been charged.

As the photoreceptor belt 10 moves, the image area passes through a charging station A. At charging station A, a corona generating device, indicated generally by the reference numeral 22, charges the image area to a relatively high and substantially uniform potential. FIG. 2 illustrates a typical voltage profile 68 of an image area after that image area has left the charging station A. As shown, the image area has a uniform potential of about −500 volts. In practice, this is accomplished by charging the image area slightly more negative than −500 volts so that any resulting dark decay reduces the voltage to the desired −500 volts. While FIG. 2 shows the image area as being negatively charged, it could be positively charged if the charge levels and polarities of the toners, recharging devices, photoreceptor, and other relevant regions or devices are appropriately changed.

Figure 3:
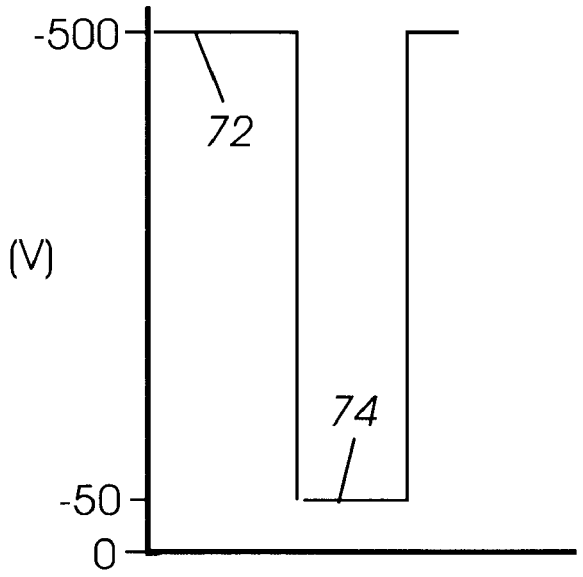
FIG. 3 shows a typical voltage profile of the image area after being exposed.

After passing through the charging station A, the now charged image area passes through a first exposure station B. At exposure station B, the charged image area is exposed to light which illuminates the image area with a light representation of a first color (say black) image. That light representation discharges some parts of the image area so as to create an electrostatic latent image. While the illustrated embodiment uses a laser based output scanning device 24 as a light source, it is to be understood that other light sources, for example an LED printbar, can also be used with the principles of the present invention. FIG. 3 shows typical voltage levels, the levels 72 and 74, which might exist on the image area after exposure. The voltage level 72, about −500 volts, exists on those parts of the image area which were not illuminated, while the voltage level 74, about −50 volts, exists on those parts which were illuminated. Thus after exposure, the image area has a voltage profile comprised of relative high and low voltages.

After passing through the first exposure station B, the now exposed image area passes through a first development station C which is identical in structure with development system E, G, and I. The first development station C deposits a first color, say black, of negatively charged toner 31 onto the image area. That toner is attracted to the less negative sections of the image area and repelled by the more negative sections. The result is a first toner powder image on the image area.

Figure 4:
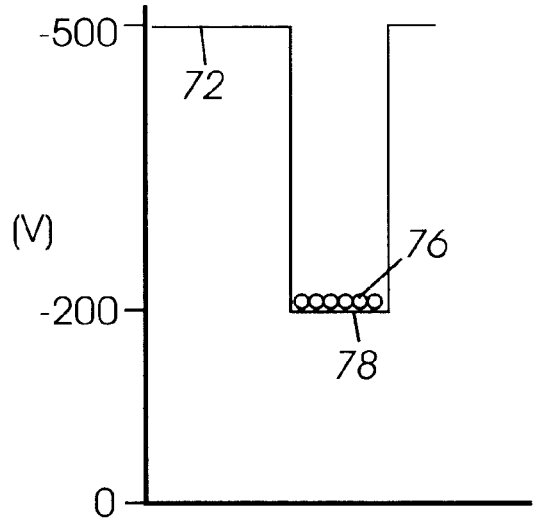
FIG. 4 shows a typical voltage profile of the image area after being developed.

FIG. 4 shows the voltages on the image area after the image area passes through the first development station C. Toner 76 (which generally represents any color of toner) adheres to the illuminated image area. This causes the voltage in the illuminated area to increase to, for example, about −200 volts, as represented by the solid line 78. The unilluminated parts of the image area remain at about the level 72.

After passing through the first development station C, the now exposed and toned image area passes to a first recharging station D. The recharging station D is comprised of two corona recharging devices, a first recharging device 36 and a second recharging device 37, which act together to recharge the voltage levels of both the toned and untoned parts of the image area to a substantially uniform level. It is to be understood that power supplies are coupled to the first and second recharging devices 36 and 37, and to any grid or other voltage control surface associated therewith, as required so that the necessary electrical inputs are available for the recharging devices to accomplish their task.

Figure 5:
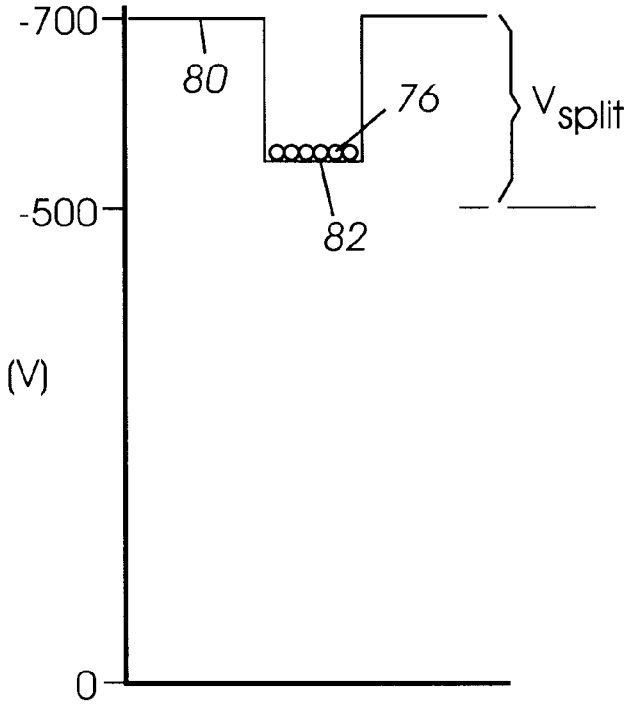
FIG. 5 shows a typical voltage profile of the image area after being recharged by a first recharging device.

FIG. 5 shows the voltages on the image area after it passes through the first recharging device 36. The first recharging device overcharges the image area to more negative levels than that which the image area is to have when it leaves the recharging station D. For example, as shown in FIG. 5 the toned and the untoned parts of the image area, reach a voltage level 80 of about −700 volts. The first recharging device 36 is preferably a DC scorotron.

Figure 6:
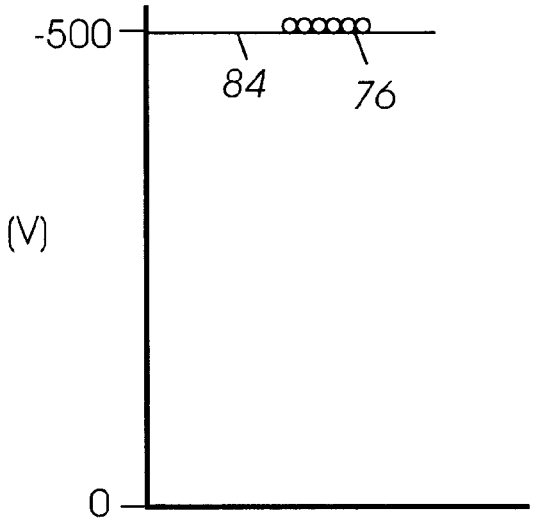
FIG. 6 shows a typical voltage profile of the image area after being recharged by a second recharging device.

After being recharged by the first recharging device 36, the image area passes to the second recharging device 37. Referring now to FIG. 6, the second recharging device 37 reduces the voltage of the image area, both the untoned parts and the toned parts (represented by toner 76) to a level 84 which is the desired potential of −500 volts.

Figure 7:
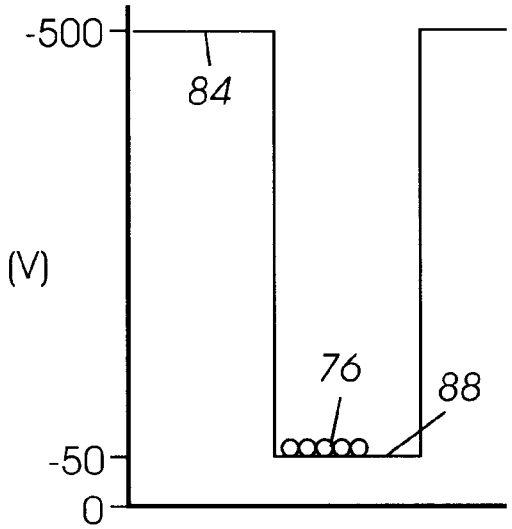
FIG. 7 shows a typical voltage profile of the image area after being exposed for a second time.

After being recharged at the first recharging station D, the now substantially uniformly charged image area with its first toner powder image passes to a second exposure station 38. Except for the fact that the second exposure station illuminates the image area with a light representation of a second color image (say yellow) to create a second electrostatic latent image, the second exposure station 38 is the same as the first exposure station B. FIG. 7 illustrates the potentials on the image area after it passes through the second exposure station. As shown, the non-illuminated areas have a potential about −500 as denoted by the level 84. However, illuminated areas, both the previously toned areas denoted by the toner 76 and the untoned areas are discharged to about −50 volts as denoted by the level 88.

The image area then passes to a second development station E. Except for the fact that the second development station E contains a toner 40 which is of a different color (yellow) than the toner 31 (black) in the first development station C, the second development station is beneficially the same as the first development station. Since the toner 40 is attracted to the less negative parts of the image area and repelled by the more negative parts, after passing through the second development station E the image area has first and second toner powder images which may overlap.

The image area then passes to a second recharging station F. The second recharging station F has first and second recharging devices, the devices 51 and 52, respectively, which operate similar to the recharging devices 36 and 37. Briefly, the first corona recharge device 51 overcharges the image areas to a greater absolute potential than that ultimately desired (say −700 volts) and the second corona recharging device, comprised of coronodes having AC potentials, neutralizes that potential to that ultimately desired.

The now recharged image area then passes through a third exposure station 53. Except for the fact that the third exposure station illuminates the image area with a light representation of a third color image (say magenta) so as to create a third electrostatic latent image, the third exposure station 38 is the same as the first and second exposure stations B and 38. The third electrostatic latent image is then developed using a third color of toner 55 (magenta) contained in a third development station G.

The now recharged image area then passes through a third recharging station H. The third recharging station includes a pair of corona recharge devices 61 and 62 which adjust the voltage level of both the toned and untoned parts of the image area to a substantially uniform level in a manner similar to the corona recharging devices 36 and 37 and recharging devices 51 and 52.

After passing through the third recharging station the now recharged image area then passes through a fourth exposure station 63. Except for the fact that the fourth exposure station illuminates the image area with a light representation of a fourth color image (say cyan) so as to create a fourth electrostatic latent image, the fourth exposure station 63 is the same as the first, second, and third exposure stations, the exposure stations B, 38, and 53, respectively. The fourth electrostatic latent image is then developed using a fourth color toner 65 (cyan) contained in a fourth development station I.

To condition the toner for effective transfer to a substrate, the image area then passes to a pretransfer corotron member 50 which delivers corona charge to ensure that the toner particles are of the required charge level so as to ensure proper subsequent transfer.

After passing the corotron member 50, the four toner powder images are transferred from the image area onto a support sheet 52 at transfer station J. It is to be understood that the support sheet is advanced to the transfer station in the direction 58 by a conventional sheet feeding apparatus which is not shown. The transfer station J includes a transfer corona device 54 which sprays positive ions onto the backside of sheet 52. This causes the negatively charged toner powder images to move onto the support sheet 52. The transfer station J also includes a detack corona device 56 which facilitates the removal of the support sheet 52 from the printing machine 8.

After transfer, the support sheet 52 moves onto a conveyor (not shown) which advances that sheet to a fusing station K. The fusing station K includes a fuser assembly, indicated generally by the reference numeral 60, which permanently affixes the transferred powder image to the support sheet 52. Preferably, the fuser assembly 60 includes a heated fuser roller 62 and a backup or pressure roller 64. When the support sheet 52 passes between the fuser roller 62 and the backup roller 64 the toner powder is permanently affixed to the sheet support 52. After fusing, a chute, not shown, guides the support sheets 52 to a catch tray, also not shown, for removal by an operator.

After the support sheet 52 has separated from the photoreceptor belt 10, residual toner particles on the image area are removed at cleaning station L via a cleaning brush contained in a housing 66. The image area is then ready to begin a new marking cycle.

The various machine functions described above are generally managed and regulated by a controller which provides electrical command signals for controlling the operations described above.

Figure 8:
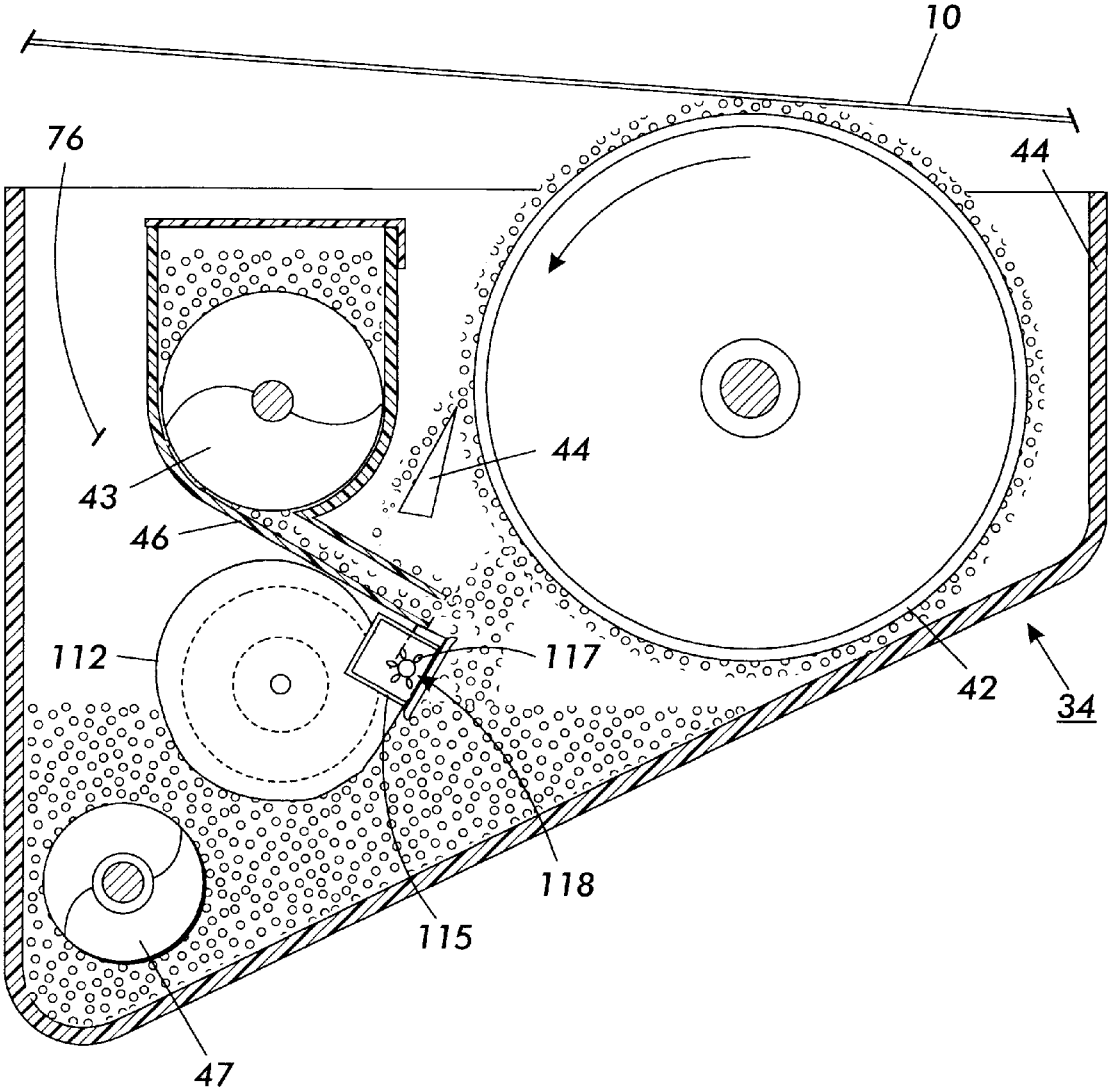
FIG. 8 is a schematic elevational view showing the development apparatus used in the FIG. 1 printing machine.

Turning to FIG. 8, which illustrates the development system 34 in greater detail, development system 34 includes a housing 44 defining a chamber 76 for storing a supply of toner. Fresh neutral toner enters the development system 34 through the toner dispense auger 43 and toner moves down toner supply chute 46, where the toner is contacted with a low velocity air stream. The air stream is generated by blower 112, mounted in the air stream is an ion charging device 115. Ion charging device 115 includes a corona wire 117 and a biased shield 118, which charges the air stream. The charged air stream fluidizes the toner and charges the toner to a desired charge level and directs it to the surface of the donor roll 42 forming a uniform layer of charged toner which adheres to the donor 42 due to the natural force of attraction between charged toner particles and the donor surface . This charged toner layer is then moved in proximity to the photoreceptor by the rotation of the donor member 42 where it preferentially develops into the image areas 74 . Toner which was not deposited in the image areas on the photoreceptor 10 is removed from donor 42 by a device such as a blade 44 where some falls back into the development housing sump 48 and some is recharged for use to develop subsequent latent images. As toner in the sump rises above a predetermined level, it is removed from the development housing by auger 47, mixed with fresh toner as needed and sent back into the housing through the toner dispense auger 43.

An AC and DC bias is applied to the donor member 42, the frequency being on the order of 3.5 khz at an amplitude of 1 kv. The DC bias voltage is chosen to lie between the voltage 74 and the background voltage 72 which, in this case would be −150 volts. This approach would be appropriate for the first color separation, we would need a somewhat different approach in the development zones on donor member 42 for development stations E,G and I which would enable non-scavenging operation for these systems.

In order to minimize the creation of such fluctuation in adhesive forces, there has been provided, in the preferred embodiment of the invention, a toner conveyor chute for dispensing toner in the vicinity of a charging orifice, a corona device contained in a structure to generate ions which are entrained in an air stream, an orifice for ejecting these air entrained ions, and a donor member onto which the charged toner particles are loaded. This donor member is shown to be a donor roll here but ,in fact, may be a donor belt or other such member which will present charged toner to the latent image. The device effectively fluidizes, charges and loads the toner onto the donor member in one step, greatly simplifying the system. The corona wires are enclosed in an air manifold structure containing air at a positive pressure which keeps the corona wire from becoming contaminated, greatly improving reliability.

It is, therefore, apparent that there has been provided in accordance with the present invention that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. A developer system for developing a latent image of an image bearing member with charge toner particles, the system comprising:

a housing for containing toner particles;

a donor member, mounted in said housing, for transporting charged toner particles on the surface said donor member to a development zone adjacent to said image bearing member;

a loading system for loading said donor member with charged toner particles, said loading system includes means for generating an air stream for fluidizing toner particles and means for charging said air stream.

2. The developer system of claim 1, wherein said loading system includes a toner dispenser in fluid communication with entrance port of a toner supply chute, wherein toner moves to an exit port of said toner supply chute where toner is contacted with said charged air stream.

3. The developer system of claim 2, wherein said air stream is generated by blower, mounted in the air stream is an ion charging device.

4. The developer system of claim 3, wherein said ion charging device includes a corona wire and a biased shield, which charges the air stream whereby the charged air stream fluidizes the toner and charges the toner to a desired charge level and directs it to the surface of the donor member forming a uniform layer of charged toner on the donor member.

5. A method for charging and loading toner onto a donor member, comprising the steps of:

generating an air stream directed at the donor member;

charging the air stream with a charging device;

ejecting uncharged toner into the charged air stream; and biasing said donor member to a polarity opposite of the charged toner.

6. The method of claim 5, wherein said ejecting step includes generating fluidized bed of said toner with said air stream.

* * * * *